US007171882B2

(12) United States Patent
Shteyngarts

(10) Patent No.: US 7,171,882 B2
(45) Date of Patent: Feb. 6, 2007

(54) KNIFE-LIKE CUTTING DIE

(75) Inventor: Gregory A. Shteyngarts, Solon, OH (US)

(73) Assignee: Amros Industries, Inc., Cleveland, OH (US)

( * ) Notice: Subject to any disclaimer, the term of this patent is extended or adjusted under 35 U.S.C. 154(b) by 0 days.

(21) Appl. No.: 10/686,196

(22) Filed: Oct. 15, 2003

(65) Prior Publication Data

US 2005/0081691 A1 Apr. 21, 2005

(51) Int. Cl.
*B26D 7/10* (2006.01)
*B26D 5/20* (2006.01)

(52) U.S. Cl. ..... 83/171; 83/16; 83/123; 83/170; 83/182; 83/699.31; 83/139; 83/697; 83/268; 83/418; 83/685; 29/465; 264/138; 264/157

(58) Field of Classification Search ..... 83/171, 83/124, 15, 16, 170, 128–138, 182, 699.31, 83/699.41, 183, 699.21, 139, 697, 268, 418, 83/685; 261/157, 138, 153, 154, 155, 237, 261/319, 348; 425/289, 384; 156/250–252, 156/510, 515; 29/464–468; 264/157, 138, 264/153, 155, 237, 319
See application file for complete search history.

(56) References Cited

U.S. PATENT DOCUMENTS 1,343,383 A * 6/1920 Bilello ..... 83/654
1,939,478 A * 12/1933 Whistler ..... 83/685
2,122,368 A * 6/1938 Engler ..... 83/862
2,313,801 A * 3/1943 Carll ..... 83/691
2,425,388 A * 8/1947 Oestricher ..... 156/515
2,706,238 A * 4/1955 Blaser ..... 83/170
3,122,048 A * 2/1964 Warner ..... 411/535
3,240,851 A * 3/1966 Scalora ..... 264/153
3,440,909 A * 4/1969 Alois et al. ..... 83/61

(Continued)

FOREIGN PATENT DOCUMENTS

JP 405154795 A * 6/1993 ..... 83/522

OTHER PUBLICATIONS

Larry Koester et al., Thermoforming & Die Cutting of Recycled/Virgin PET Sheet, 2002, pp. 1-28 and 1-5, Thermoforming & Die Cutting of Recycled/Virgin PET Sheet, Quebec, Canada.

(Continued)

*Primary Examiner*—Boyer D. Ashley
*Assistant Examiner*—Ghassem Alie
(74) *Attorney, Agent, or Firm*—Tarolli, Sundheim, Covell & Tummino, LLP

(57) ABSTRACT

A knife-like die for cutting a thermoformed plastic article from a sheet of thermoformable plastic. The die includes a die build up plate that is mounted to a first platen and a striker plate that is mounted to a second platen. The die further includes a die board having a knife element mounted thereto. A heating element heats the knife to a temperature that allows for easy cutting of the thermoformable plastic. The die board also includes a die travel stop which prevents the die from being forced into the striker plate thus damaging the knife element and a die location pilot that engages a feature on the sheet of thermoformable plastic to align the article with the die.

4 Claims, 3 Drawing Sheets

U.S. PATENT DOCUMENTS 3,526,694 A * 9/1970 Lemelson ..... 264/259
3,587,377 A * 6/1971 Olson ..... 83/171
3,596,317 A * 8/1971 Nicholson ..... 425/128
3,605,477 A * 9/1971 Carlson ..... 72/342.4
3,623,209 A * 11/1971 Zuhlke et al. ..... 29/413
3,640,666 A * 2/1972 Jope et al. ..... 425/302.1
3,755,522 A * 8/1973 Jope et al. ..... 264/548
3,802,308 A * 4/1974 Davis, Jr. ..... 83/99
3,833,439 A * 9/1974 Smith ..... 156/219
3,982,458 A * 9/1976 Terasaka ..... 83/685
4,051,754 A * 10/1977 Harcuba et al. ..... 83/124
4,064,776 A * 12/1977 Walitalo et al. ..... 83/171
4,243,366 A * 1/1981 Lefevre et al. ..... 425/303
4,431,172 A * 2/1984 Soda et al. ..... 267/119
4,559,800 A * 12/1985 Brown ..... 72/342.8
4,633,810 A * 1/1987 Martin ..... 118/721
4,700,481 A * 10/1987 Barrett ..... 30/475
4,730,761 A * 3/1988 Spano ..... 225/2
4,823,660 A * 4/1989 Forthmann ..... 83/123
4,844,852 A * 7/1989 Keyser et al. ..... 264/153
4,951,537 A * 8/1990 Bennett ..... 83/76.6
5,393,474 A * 2/1995 Souders ..... 264/163
5,451,288 A * 9/1995 Smith et al. ..... 156/359
5,794,339 A * 8/1998 Pearson et al. ..... 29/889.5
5,795,535 A * 8/1998 Giovannone et al. ..... 264/551
6,056,531 A * 5/2000 Furuya et al. ..... 425/302.1
2002/0104413 A1* 8/2002 Adachi et al. ..... 83/16
2002/0166428 A1* 11/2002 Oh et al. ..... 83/62
2002/0174947 A1* 11/2002 Davis et al. ..... 156/321

OTHER PUBLICATIONS

Stanley R. Rosen, Factors to Consider When Trimming Thin-Gage Shots Using a Knife-Like Die, Thermoforming Quarterly, (date unknown), pp. 14-17, Thermoforming Quarterly, United States.

* cited by examiner

KNIFE-LIKE CUTTING DIE

FIELD OF THE INVENTION

The present relates to cutting dies, more specifically, to a cutting die for use in cutting thermoformed plastic containers.

BACKGROUND

The use of thermoformable plastic such as polyethylene terephthalate (PET) for packaging has risen sharply in recent years, replacing glass and aluminum in many applications. To manufacture the thermoformable plastic containers, plastic, in the form of sheets, is heated, formed and then trimmed from the sheet. To facilitate trimming, the plastic around the article being trimmed is often heated prior to trimming. One type of trimming system that is employed uses a steel-rule die in which a knife blade that is held in a wooden board is brought into contact with a heated striker plate to sever the plastic article from the sheet of plastic. While the steel-rule die is relatively inexpensive and provides satisfactory cutting characteristics, steel rule dies are less durable than more costly die alternatives such as machined tool steel dies and forged dies. This is because the steel-rule is susceptible to damage from the pressure between the cutting edge and the striker plate. A typical steel-rule die has a life of 5,000 strikes before it must be replaced or sharpened.

SUMMARY

A die for a trim press that cuts thermoplastic articles from thermoformable plastic is made more durable by incorporating features that reduce the pressure put on the knife blade during cutting. A positive stop that limits die travel also limits the resulting pressure on the knife blade. A heating element that heats the knife blade softens the thermoformable plastic on contact to reduce the pressure necessary to cut the plastic. A material sensing circuit can be formed by sensing direct contact between conductive portions of the die and striker plates to indicate the absence of thermoplastic material and cause retraction of the die before damage is done to the knife. Die registration features can be incorporated into the positive stop to align the die and the article prior to cutting.

DETAILED DESCRIPTION

Figure 4:
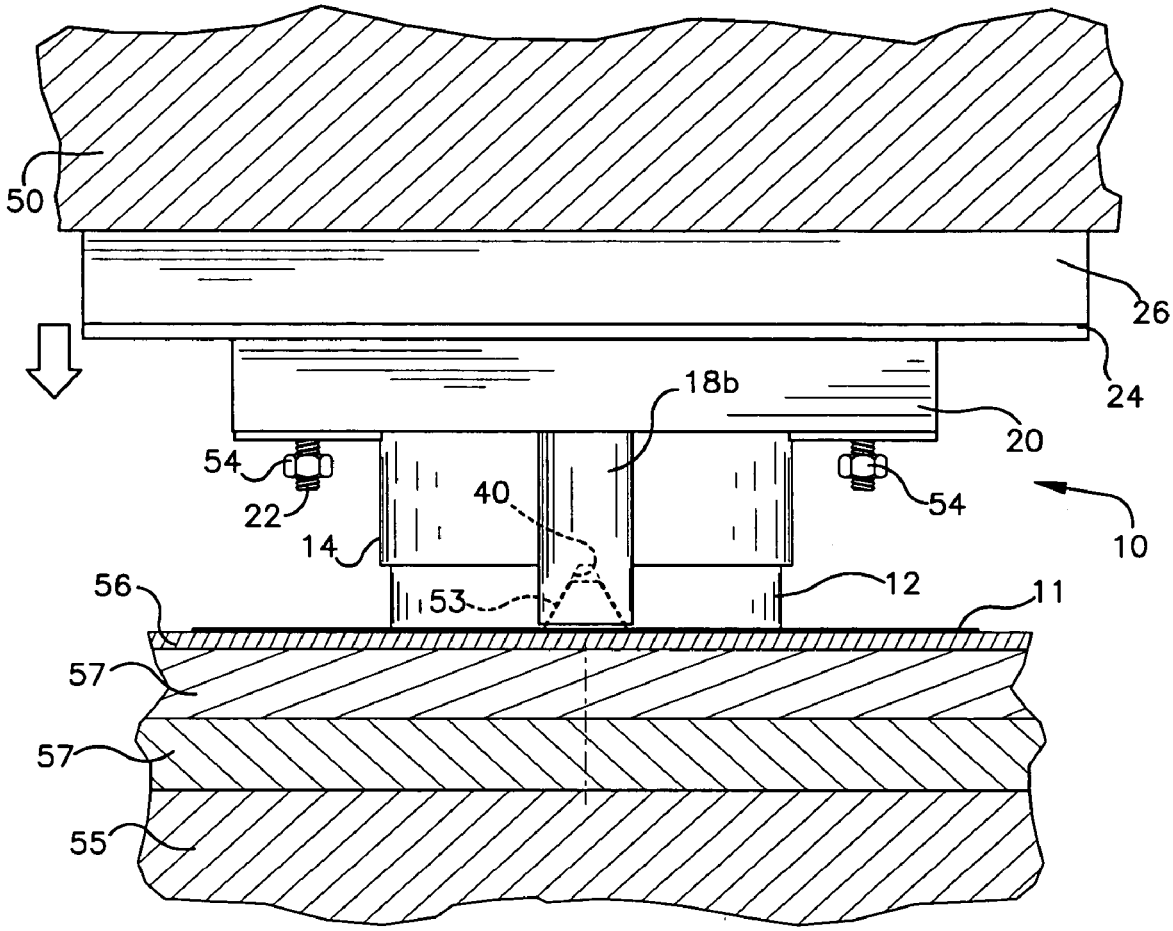
FIG. 4 is a side view of a trim press with the cutting die of FIG. 1 installed.

Turning first to FIG. 4, a cutting die 10 is shown in a trim press assembly. The die 10 is secured to an upper platen 50 on the trim press via a series of build up plates 24, 26 that will be described in more detail later. The arrow in FIG. 4 shows the direction of platen travel during a cutting action. The die 10 acts against a lower trim build up plate 56, sometimes referred to as a striker plate, located on a lower platen 55 to cut a plastic article 53 from a sheet of thermoplastic material 11. The trim build up plate 56 on the platen 55 provides a solid, flat surface against which the cutting die can work. A plurality of auxiliary build up plates 57 provide additional support for the trim build up plate 56.

Figure 1:
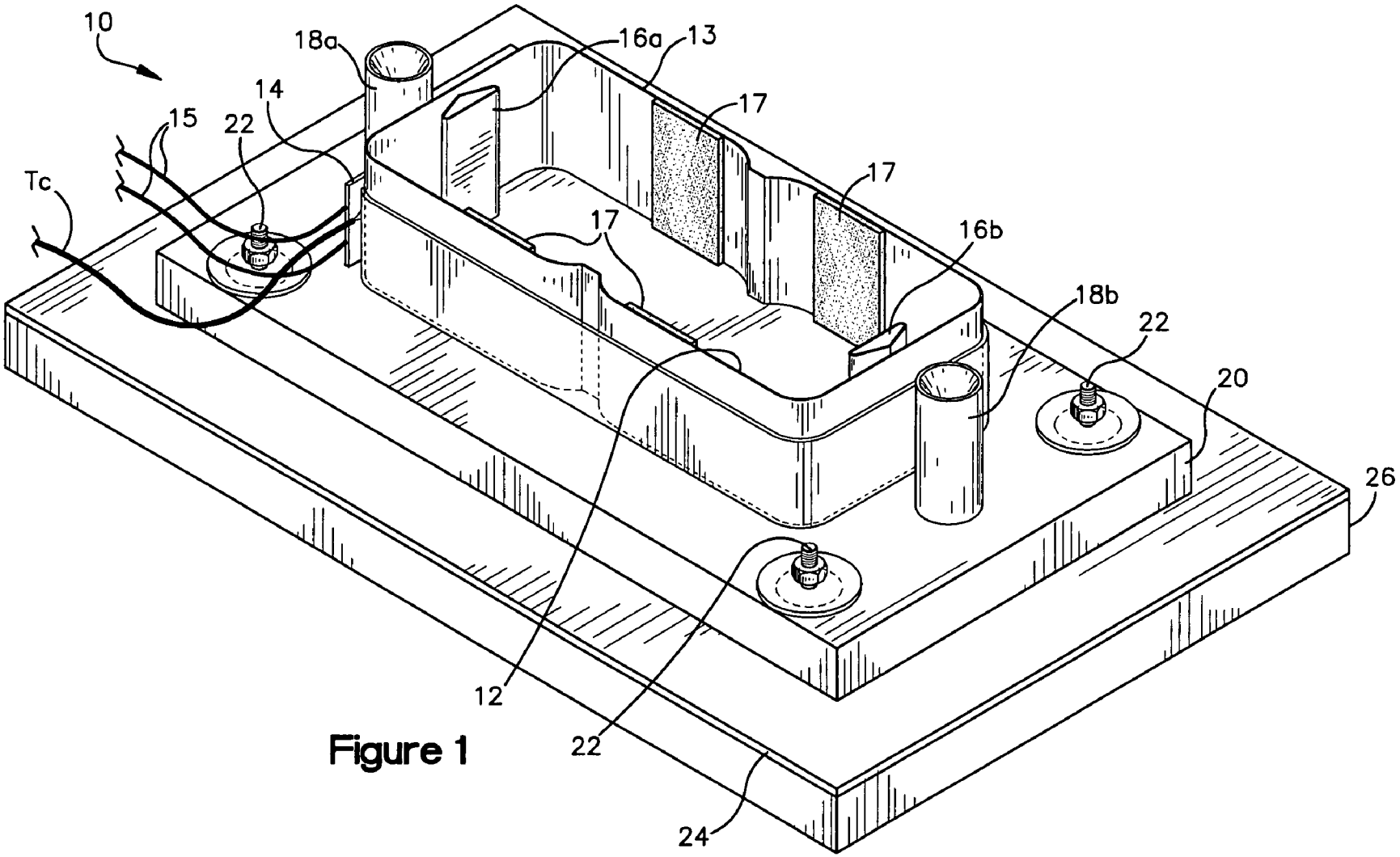
FIG. 1 is a perspective view of the cutting die according to the present invention.
Figure 2:
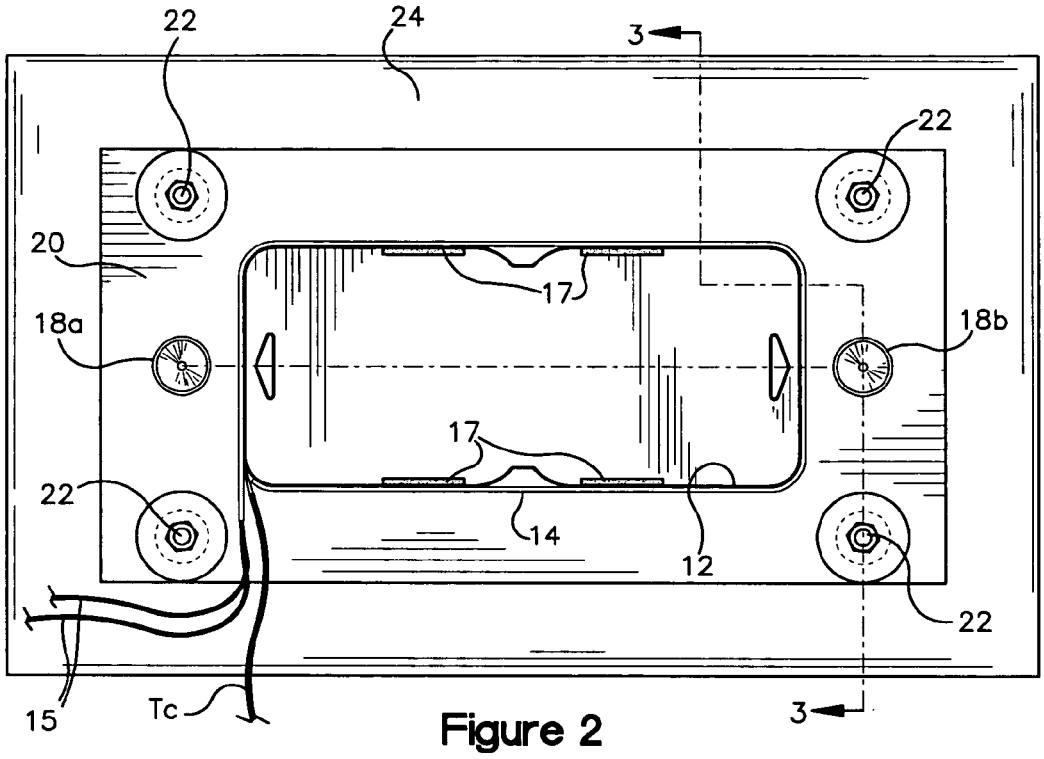
FIG. 2 is a top view of the cutting die shown in FIG. 1.

Turning now to the figures, FIG. 1 and FIG. 2 show cutting die 10 having a cutting blade 12 mounted to a die board 20. The cutting die 10 further includes two triangular cutting blades 16*a*, 16*b*. Cutting blades 16*a*, 16*b* cut out a triangular shaped hole in the plastic packaging which can be used as a hanger for the packaging. Additional cutting blades may be incorporated as needed. The cutting blade 12 can take on any shape depending on the shape of the containers being made. In the disclosed embodiment, the cutting blade 12 takes on a generally rectangular shape having a central indentation on either side. The cutting blade 12 is normally made of steel. The hardness of the steel used is dependent on desired cutting characteristics. For cutting simple designs, a blade with a steel hardness of 50–55 Rockwell C may be employed. The harder steel blades tend to wear better than softer steel. However, softer dies on the order of 45–50 Rockwell C may have to be used to prevent breakage during die formation when complex shapes and sharp bends are used. The cutting blade 12 includes a cutting edge 13 that engages an article to be cut. A heating element 14 surrounds the cutting blade 12 such that it is in thermal communication with the cutting blade 12. The heating element 14 is supplied power by two leads 15. During operation, the heating element heats the cutting blade 12 to a predetermined temperature that assists the cutting blade 12 in cutting the plastic material 11. The temperature to which the cutting blade 12 is heated is dependent on the material being cut. Preferably, the blade 12 is heated enough to allow easy cutting of the material but does not cause the material to become "stringy" or melt during the cutting operation. For instance, when cutting PET the blade 12 is heated to a temperature of about 220° to about 230° F. At this temperature, the PET material is easily cut without melting the PET or causing it to become "stringy."

Heating the cutting blade 12 minimizes the force needed to cut the plastic material 11 thereby decreasing the wear on the cutting surface 13. However, the temperature of the cutting blade 12 is kept below a temperature at which plastic material 11 would stick to the cutting blade 12. In order to monitor the temperature of the cutting blade 12, a thermocouple TC is inserted between the heating element 14 and the cutting blade 12. In a preferred embodiment, the thermocouple is connected to a monitor along with leads 15. The monitor measures the temperature through the thermocouple TC and applies the appropriate amount of power to the heating element 14 through leads 15 to maintain a constant temperature of the cutting blade 12.

The cutting die 10 further includes stoppers 18*a* and 18*b* which are located at either end of the die board adjacent to the cutting blade 12 but not located in the area defined by the blade 12. The stoppers 18*a*, 18*b* extend through the die board 20 to a distance just below the top of the cutting blade 12. The distance from the top of the of the stoppers 18*a*, 18*b* to the top of the cutting blade 12 is preferably equal to the thickness of the plastic to be cut. During operation, the cutting die 10 presses down on the plastic material 11 to begin the cutting process. Pressure is applied until the travel of the die is prevented due to the stoppers 18*a*, 18*b* contacting the plastic material 11 and the striker plate 56. During this procedure, the cutting blade 12 cuts the plastic article 11 in a direction towards the striker plate 56. Use of the stoppers 18*a*, 18*b* prevents excessive pressure on the cutting blade 12 thus preventing damage. The stoppers only allow the blade 12 to cut to a predetermined depth, based on the height difference between the top of the stoppers 18*a*, 18*b* and the top of the cutting edge 13, taking into account the thickness of the plastic material 11, in turn reducing wear to the cutting edge 13 associated with excessive pressures in the cutting process.

The internal surface of the cutting blade 12 has affixed thereto ejectors 17 which are used to aid in removal of the cut article from the inside of the cutting die 10 upon completion of the cut. As the cut is being performed, the ejectors 17 are compressed by the article as pressure is being applied to the cutting die 10. Once the cut is made, the die is then retracted away from the cut article and the ejectors 17 begin to decompress, expelling the cut portion of the article from the inside periphery of the cutting blade 12. The ejectors 17 can be constructed from any material as apparent to one of ordinary skill in the art in view of this disclosure. In the preferred embodiment, the ejectors 17 are constructed from a rubber compound.

The die board 20 is loosely coupled to a metal trim die buildup plate 24 by bolts 22. The trim die buildup plate 24 is preferably metal and acts to prevent deflection of the die during the cutting cycle. An additional second build up plate 26 further adds to the stability of the cutting die 10 during operation. The second buildup plate 26 is preferably wood but can be constructed from other materials to provide more or less weight if needed.

Figure 3:
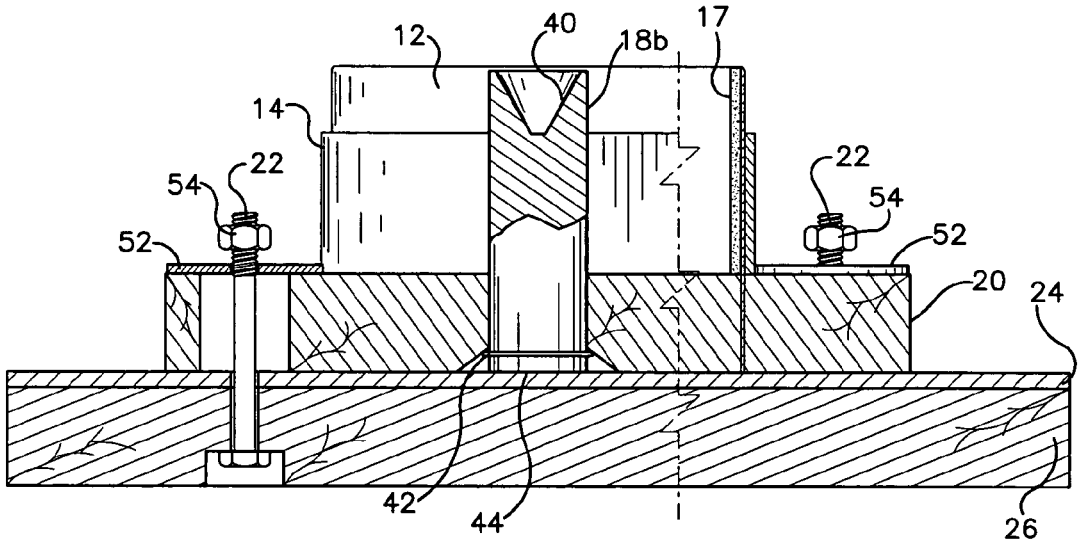
FIG. 3 is a cross-sectional view of the cutting die of FIG. 2 taken along ling 3—3.

Turning now to FIG. 3, a cross-sectional view of the cutting die is illustrated showing the stopper 18*b* and the connection of the die board 20 to the buildup plates 24, 26. The die board 20 is loosely mounted to the buildup plate 24 via the threaded bolt 22. The threaded bolt 22 extends through the second buildup plate 26, metal buildup plate 24, and the die board 20. The die board 20 includes a bore for housing the threaded bolt 22. The bore is larger in diameter than the diameter of the threaded bolt 22. This allows the die board 20 to move on the build up plate 24 in both a longitudinal and latitudinal direction. The threaded bolt 22 is held loosely in place by a nut 54. A washer 52 is placed over the threaded bolt 22 between the nut 54 and the die board 20 so that the nut 54 cannot fall back through the bore in the die board 20. This creates a loose connection fastening the die board 20 with the buildup plates 24, 26 yet allows the die board 20 freedom of movement for adjustments during the cutting cycle.

The stoppers 18*a*, 18*b* (18*b* shown) include a conical internal surface 40. This surface mates with a protrusion on the plastic material 11 such that the cutting die is properly aligned to make a cut in an exact location. During the operation of the cutting cycle, the plastic material 11 is moved on the striker plate under the cutting die 10. The cutting die 10 is then lowered onto the sheet to perform the cut. As the die is lowered, the conical protrusion on the sheet aligns with the conical internal wall 40. As described, the die board 20 is loosely connected to the buildup plates, therefore, the die board 10 can easily move into alignment with the protrusion on the plastic material 11 by aligning with the internal conical wall 40 of the stopper 18*b*. In an alternative embodiment, the alignment can take place by having the die board securely mounted to the buildup plates while the plastic material 11 is moved into alignment with the die board.

In the present embodiment, the stopper 18*b* extends from the buildup plate 24 to a point just below the top of the cutting blade 12. The bottom of the die board 20 includes a chamfer which allows the bottom of the stopper 18*b* to sit flush on the buildup plate 24. The stopper is prevented from dislodging from the die board 20 by a retaining ring 42. The retaining ring is larger in diameter than the bore in the die board 24 that houses the stopper 18*b* thus preventing the stopper from dislodging. The stopper 18*b* contacts the buildup plate at a joining surface area 44. By contacting the buildup plate directly, minimal damage from cutting pressure is imparted to the die board 20 because the pressure is at least in part absorbed by the buildup plate 24.

During operation, it is helpful to determine if the sheet of preformed plastic material 11 is present under the cutting die and ready for cutting. If no material is present and the press is activated, damage could be done to the cutting die. Therefore, it is necessary to determine if the material is present for the cutting operation. One way to do this is to apply and electrical current to the cutting blade itself or to the metal build up plate. As the pressed is lowered, if no material is present, the blade will make contact with the striker plate and complete a circuit through the blade and the striker plate. Completion of the circuit signals the die drive to retract thereby minimizing damage to the blade. In an alternative, current can be applied to the die build up plate 24. Current is then transferred to the cutting blade due to the blades contact with the buildup plate 24. In FIG. 3, the cross-section shows the blade making contact with the buildup plate 24, however, the blade does not contact the buildup plate in all regions but rather bridges the board in these bridging regions to prevent the section of the die board within the blade from being severed. Contact between the blade and buildup plate occurs in several sections around the perimeter of the blade thereby connecting the cutting blade 12 to the die board 20.

In the foregoing description, the invention has been described with reference to specific exemplary embodiments thereof. It will, however, be evident that various modifications and changes may be made thereto without departing from the broader spirit or scope of the present invention as defined in the appended claims. The specification and drawings are, accordingly, to be regarded in an illustrative rather that a restrictive sense.

I claim:

1. For use with a trim press having a die build up plate that is mounted to a first platen, a striker plate that is mounted to a second platen, and wherein the trim press moves the first platen such that the trim press travels between a load position in which a cutting edge is spaced from the striker plate and a cutting position in which the cutting edge confronts the striker plate, a die for cutting a thermoformed plastic article from a sheet of thermoformable plastic that rests upon the striker plate comprising:

a) a knife element having a inner portion and outer portion, said knife element connected to said die build up plate that includes a cutting edge for severing a thermoformable plastic sheet when the knife element confronts a striker plate and at least one cutting blade for cutting a hanger hole in said plastic sheet, said knife element having at least one ejector fixed to an internal surface;

b) a band heater adhered to, and circumscribing said outer portion of said knife element for substantially uniform heating the knife element;

c) a feedback sensing unit positioned between and in direct contact with said knife element and said band heater for communicating temperature readings of said knife element;

d) a pair of power leads connected to said band heater for controlling the amount of heat dissipated front said heating band;

e) whereby the temperature in said knife element is effectively regulated by the direct contact of said feedback sensing unit and heating band with said knife element such that variations measured by said feedback sensing unit from a target temperature results in either an increase or decrease in power to said power leads;

f) a rigid die travel stop mounted to the die build up plate that limits travel of the trim press by engaging a feature on the striker plate, and die board having a plurality of mounting holes that are oversized with respect to mounting posts on the die build up plate; and g) the rigid die travel stop having a generally conical recess at its distal end that engages a registration feature associated with the plastic article such that when the trim press is in the cutting position the registration feature co-acts with the generally conical location pilot to move the die board relative to the die build up plate along first plane such that the knife element is placed in a predetermined cutting alignment with respect to the plastic article.

2. The die of claim 1, wherein said feedback sensing unit includes a thermocouple.

3. The die of claim 1 wherein the rigid die travel stop comprises a post element that is mounted on the die build up plate that limits travel of the trim press to no further than a position at which the cutting edge first contacts the striker plate.

4. The die of claim 1, wherein said die board is moveably mounted to the die build up plate that is moveable within a range of positions along the first plane generally parallel to the sheet of thermoformable plastic and defined by the die build up plate and wherein the knife element is fixed to the die board.

* * * * *